US008132806B2

(12) United States Patent
Fuda

(10) Patent No.: US 8,132,806 B2
(45) Date of Patent: Mar. 13, 2012

(54) SHEET FEEDING DEVICE AND IMAGE FORMING APPARATUS

(75) Inventor: Munehisa Fuda, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/929,920

(22) Filed: Feb. 24, 2011

(65) Prior Publication Data

US 2011/0221119 A1 Sep. 15, 2011

(30) Foreign Application Priority Data

Mar. 10, 2010 (JP) ..... 2010-053866

(51) Int. Cl.
*B65H 3/14* (2006.01)

(52) U.S. Cl. ..... 271/98; 271/94; 271/96; 271/105; 271/108

(58) Field of Classification Search ..... 271/94, 271/98, 105, 96, 108
See application file for complete search history.

(56) References Cited

U.S. PATENT DOCUMENTS

| | | | | |
|---|---|---|---|---|
| 6,726,200 | B2 * | 4/2004 | Gohl et al. | 271/97 |
| 7,458,570 | B2 * | 12/2008 | Ueda et al. | 271/97 |
| 7,740,240 | B2 * | 6/2010 | Iwakiri | 271/97 |
| 7,744,080 | B2 * | 6/2010 | Shimoohsako | 271/97 |
| 7,841,591 | B2 * | 11/2010 | Ueda et al. | 271/98 |
| 7,913,993 | B2 * | 3/2011 | Kosugi et al. | 271/98 |
| 2004/0100013 | A1 * | 5/2004 | Mathewson | 271/98 |
| 2007/0228639 | A1 * | 10/2007 | Matsumoto et al. | 271/97 |
| 2010/0148419 | A1 * | 6/2010 | Suzuki | 271/3.11 |

FOREIGN PATENT DOCUMENTS

| | | | |
|---|---|---|---|
| JP | 2006213490 | A | 8/2006 |
| JP | 2006264980 | A | 10/2006 |
| JP | 2009274837 | A | 11/2009 |
| JP | 4516504 | A | 5/2010 |
| JP | 2010137963 | A | 6/2010 |

* cited by examiner

*Primary Examiner* — Jeremy R Severson

(74) *Attorney, Agent, or Firm* — Harness, Dickey & Pierce

(57) ABSTRACT

A sheet feeding device includes: a lift-blowing unit which blows air to a plurality of sheets stacked on a tray to lift an uppermost sheet from the sheets; a sheet absorbing unit which absorbs the sheet lifted by the lift-blowing unit by a negative pressure; an air suctioning unit which supplies the negative pressure to the sheet absorbing unit by air suction; a handling-blowing unit which handles the sheets by blowing air to the sheets absorbed onto the sheet absorbing unit; and a sheet transporting unit which transports the absorbed sheet, wherein the handling-blowing unit adjusts a volume of air blown thereby.

14 Claims, 6 Drawing Sheets

SHEET FEEDING DEVICE AND IMAGE FORMING APPARATUS

CROSS-REFERENCE TO RELATED APPLICATIONS

The present application claims priority to and incorporates by reference the entire contents of Japanese Patent Application No. 2010-053866 filed in Japan on Mar. 10, 2010.

BACKGROUND OF THE INVENTION

1. Field of the Invention

The present invention relates to a sheet feeding device and an image forming apparatus including the sheet feeding device.

2. Description of the Related Art

There is known a sheet feeding device that quickly feeds sheets one by one to an image forming apparatus or an image forming unit. FIG. 1 illustrates a schematic configuration of the sheet feeding device.

The sheet feeding device of FIG. 1 blows air from a lift-blowing unit 1 toward front ends of a plurality of sheets stacked on a tray, and lifts the sheet up to a height of a suction belt (sheet absorbing unit) 2 by the wind. Then, the suction belt 2 absorbs one sheet at the top of the sheets by operation of an air suctioning unit 30. Here, the number of sheets absorbed onto the suction belt 2 may not be one. That is, a plurality of sheets adheres to each other and may together be absorbed by the air suctioning unit 30 sometimes. Thus, air is blown from a handling-blowing unit 24 provided in each side fence (sheet side end regulating member) 23 toward the side surfaces of the sheets so that the sheets absorbed onto the suction belt 2 can be handled and thus only one sheet may be absorbed onto the suction belt 2. Then, the sheet is transported to an image forming unit by the suction belt 2 so that an image is formed thereon.

A sheet blocking member 7 is disposed between the lift-blowing unit 1 and the sheet, and prevents the sheets except for the uppermost sheet from being transported. Further, in order to maintain a constant distance h between the suction belt 2 and the position of the uppermost surface of the sheets decreased due to feeding of the sheets, a detection unit 3 is provided to detect the height of the sheets while being in contact with the uppermost surface of the sheets. The detection unit 3 includes an actuator 4 and a sensor 5 that detects the motion of the actuator. When the actuator 4 swings due to the sheets decreasing in number, the movement amount of the actuator is detected by a photo sensor or the like, and a bottom plate 6 is elevated by an elevation unit or the like on the basis of a signal generated from the sensor, so that the distance is adjusted.

The sheets are evenly aligned at the front end portions thereof on the sheet feeding tray so as to fall within the sheet size. As illustrated in FIG. 1, the attachment position of the actuator 4 is set to the vicinity of the rear end of the sheet so as not to be easily affected by the wind blown from the blower.

Transportation rollers 8 are disposed on the downstream side of the suction belt 2, and transport the sheet arriving at the rollers. The transportation force of the transportation rollers 8 is set to be larger than that of the suction belt 2. Further, a sheet feeding sensor 9 is provided on the downstream side of the transportation rollers 8 to detect whether the sheet arrives at the position of the sensor.

Next, a sheet feeding operation of the existing sheet feeding device will be described in accordance with its procedure.

(1) When a sheet feeding command is sent from an image forming apparatus body, as illustrated in FIG. 2, the lift-blowing unit 1 and the handling-blowing unit 24 operate to blow air to the end of the sheet. At the same time, the suction belt 2 starts air suction. Accordingly, an uppermost sheet P1 is lifted, and the uppermost sheet P1 is absorbed onto the suction belt as illustrated in FIG. 2.

(2) The suction belt 2 and the transportation rollers 8 start to be driven, so that the sheet P1 is transported (FIG. 3).

(3) The driving operation of the suction belt 2 stops after the sheet P1 arrives at the sheet feeding sensor 9 (FIG. 4). The transportation rollers 8 continuously transport the sheet P1 while the suction belt 2 is stopped.

(4) A next sheet P2 is lifted and absorbed onto the suction belt by air right after the sheet P1 exits a suction area (FIG. 5).

(5) The driving operation of the suction belt 2 is resumed in accordance with the sheet feeding interval that is set, so that the sheet P2 is fed.

(6) Subsequently, the sheets stacked on the tray are sequentially transported by repeating the above-described procedure from (2) to (5).

In the above-described sheet feeding operation, the volumes of air of the lift-blowing unit 1, the handling-blowing unit 24, and the air suctioning unit 30 are not described. However, if the volume of air is fixed to a certain value, the lift amount or the handling state of the sheet changes in accordance with the thickness, the weight, or the size of the stacked sheets.

For example, when the lift amount of the sheet is small, feeding failure occurs. On the contrary, when the sheet is lifted too much, the sheets adhere to each other, so that a double feeding occurs. Further, when the force of the air suctioning unit 30 is small, the sheet is not satisfactorily transported, which also causes feeding failure.

For this reason, the volume of air suitable for the stacked sheets is set in advance in order to appropriately feed the sheet, and the volume of air is automatically set when a user selects the type of sheet to be fed. Then, the volume of air is adjusted by the value of the duty of the blower. For example, the lift-blowing unit 1, the handling-blowing unit 24, and the air suctioning unit 30 are set as described in the table below.

| Sheet | Lift-blowing unit<br>Handling-blowing unit<br>Air suctioning unit |
|---|---|
| A | +30 [%]<br>+20 [%]<br>+40 [%] |
| B | +10 [%]<br>−10 [%]<br>+30 [%] |
| C | −20 [%]<br>−40 [%]<br>+20 [%] |

As for the duty of the blower, 0[%] indicates a state where the blower does not rotate at all, and 100[%] indicates a state where the blower rotates at its full power. Here, the sheets are simply described as A, B, and C, but for example, the sheets may be described by a relationship as below in accordance with the thickness or the size thereof.

Sheet thickness: A>B>C

Sheet size: A>B>C

However, even when each blower is set to have a rotation speed suitable for blowing the desired volume of air for each type of sheets, an appropriate rotation speed may not be reliably obtained due to an imbalance of the blower or a variation with time in the characteristics of the blower.

In this case, for example, when the sheet is thin or small, the rotation speed of the blower serving as the handling-blowing unit becomes faster than a predetermined rotation speed, so the sheets are not reliably handled. This may cause double feeding or feeding failure. Further, when the sheet is thick or large, the rotation speed of the blower serving as the handling-blowing unit becomes slower than a predetermined rotation speed, so that air does not appropriately flow between the sheets. This may cause a double feeding or feeding failure.

The above conventional technique is for example related to Japanese Patent Application Laid-open No. 2007-045630.

SUMMARY OF THE INVENTION

It is an object of the present invention to at least partially solve the problems in the conventional technology.

According to one aspect of the present invention, a sheet feeding device includes: a lift-blowing unit which blows air to a plurality of sheets stacked on a tray to lift an uppermost sheet from the sheets; a sheet absorbing unit which absorbs the sheet lifted by the lift-blowing unit by a negative pressure; an air suctioning unit which supplies the negative pressure to the sheet absorbing unit by air suction; a handling-blowing unit which handles the sheets by blowing air to the sheets absorbed onto the sheet absorbing unit; and a sheet transporting unit which transports the absorbed sheet, wherein the handling-blowing unit adjusts a volume of air blown thereby.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
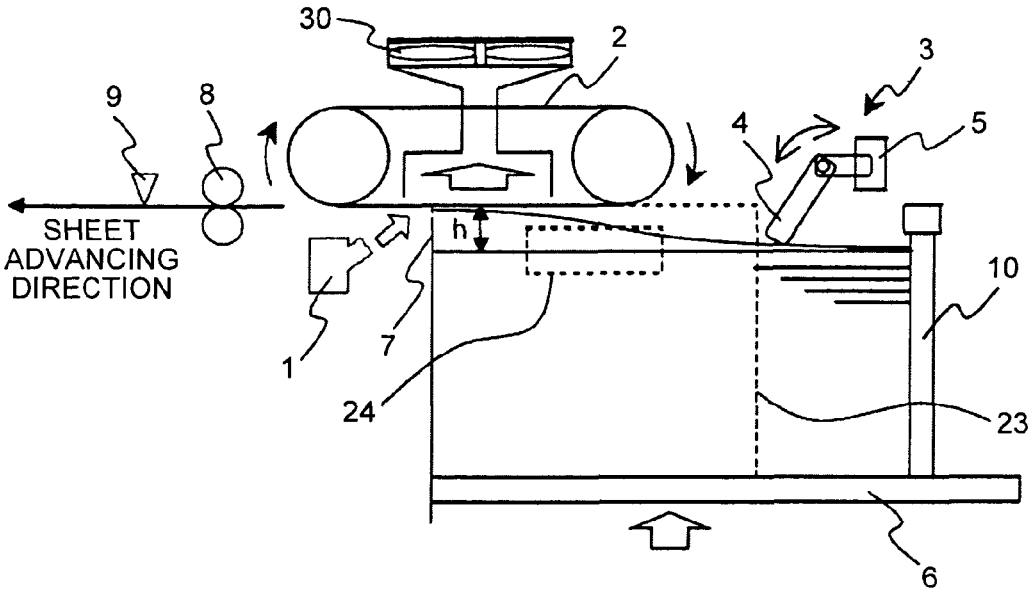
FIG. 1 is a conceptual cross-sectional view illustrating an existing sheet feeding device.
Figure 2:
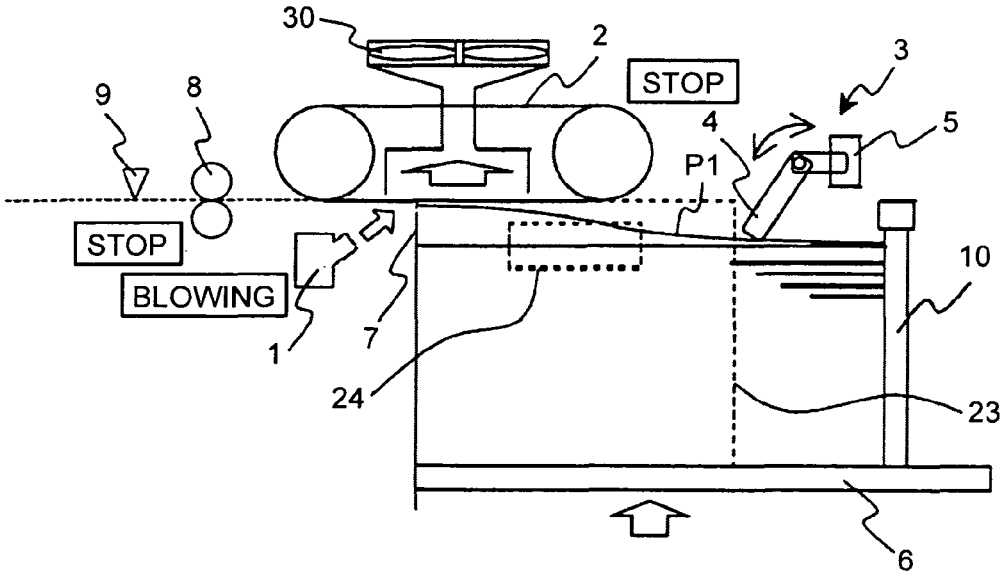
FIG. 2 is a conceptual cross-sectional view illustrating an operation in which an uppermost sheet is absorbed onto a suction belt in the sheet feeding device of FIG. 1.
Figure 3:
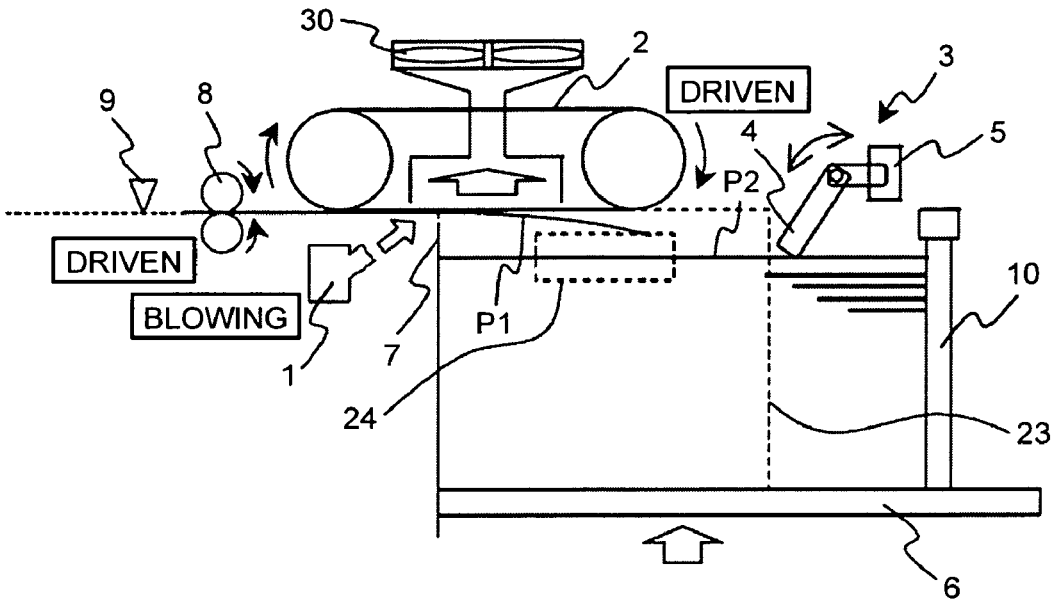
FIG. 3 is a conceptual cross-sectional view illustrating an operation in which the suction belt and transportation rollers start to be driven so that a sheet can be transported in the sheet feeding device of FIG. 1.
Figure 4:
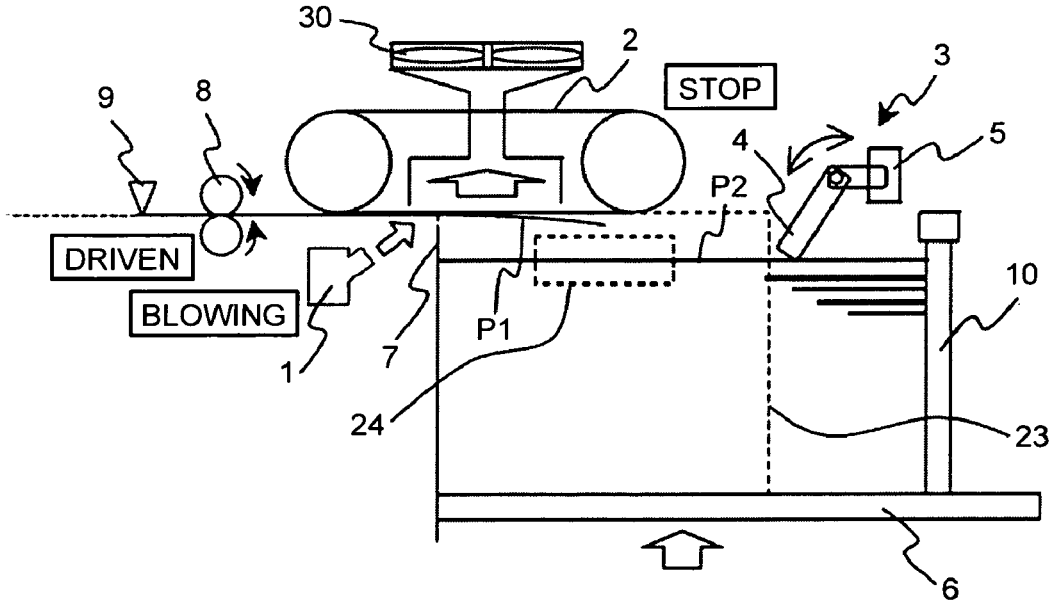
FIG. 4 is a conceptual cross-sectional view illustrating an operation in which the driving of the suction belt stops after the sheet arrives at a sheet feeding sensor in the sheet feeding device of FIG. 1.
Figure 5:
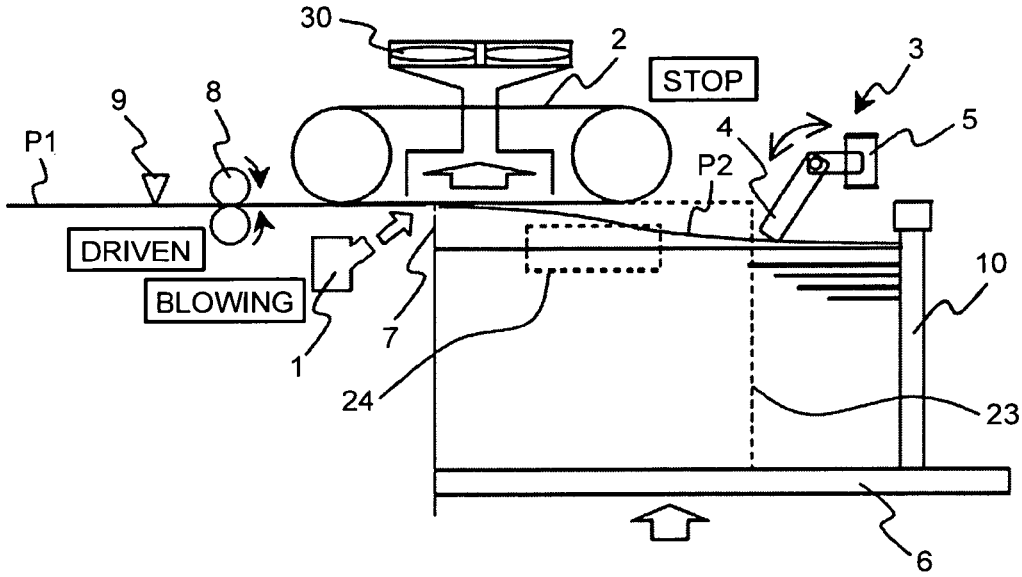
FIG. 5 is a conceptual cross-sectional view illustrating an operation in which the next sheet is lifted by air and is absorbed onto the suction belt right after the sheet exits from a suction area in the sheet feeding device of FIG. 1.

Hereinafter, a sheet feeding device and an image forming apparatus according to the invention will be described with reference to an embodiment illustrated in the drawings.

Embodiments

Figure 6:
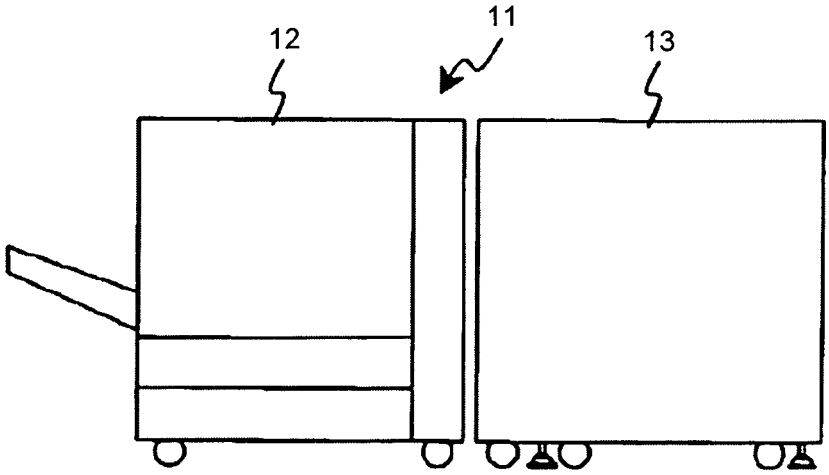
FIG. 6 is a diagram illustrating the configuration of an example of an image forming apparatus with the sheet feeding device of the invention.
Figure 7:
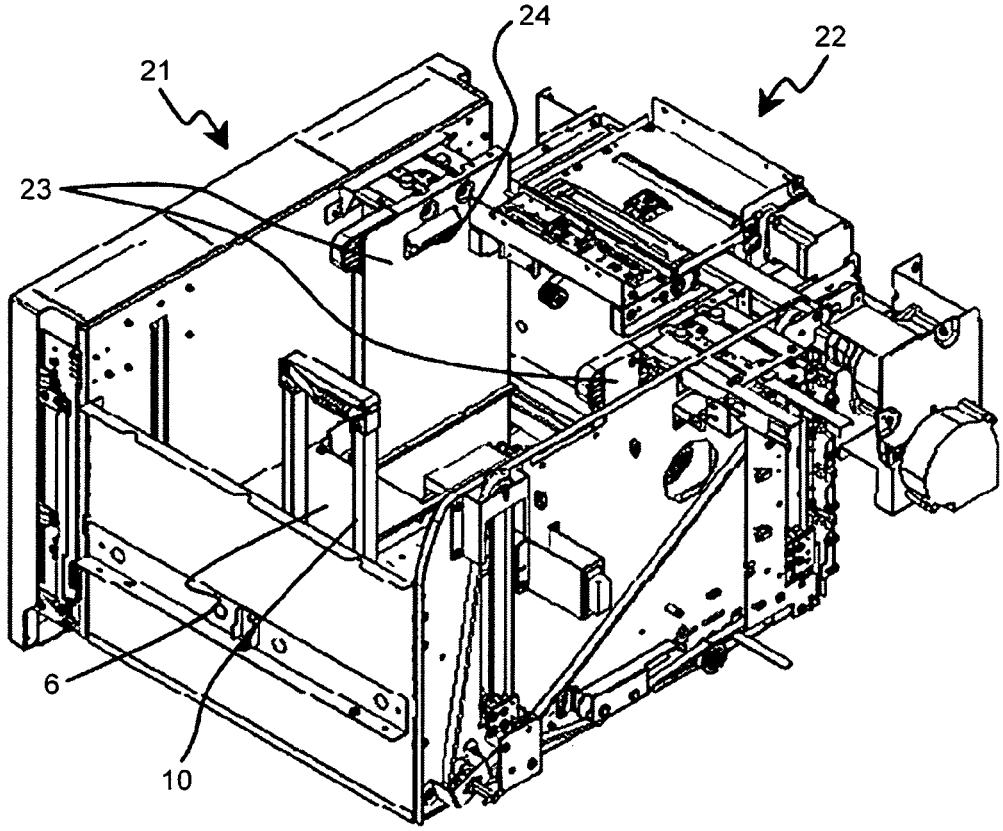
FIG. 7 is a perspective view illustrating an internal configuration of the sheet feeding device.

FIG. 6 is a diagram illustrating a configuration of one example of an image forming apparatus with a sheet feeding device of the invention. FIG. 7 is a perspective view illustrating an internal configuration of the sheet feeding device. An image forming apparatus 11 includes an image forming apparatus body 12 and a sheet feeding device 13 that is connected to one side surface of the image forming apparatus body 12.

As illustrated in FIG. 7, the sheet feeding device 13 includes a sheet feeding tray (sheet container) 21 which stacks a bundle of sheets on its bottom plate 6, and a suction belt unit (sheet feeder) 22 which takes out the uppermost sheet of the bundle of sheets one by one and feeds the sheet to the image forming apparatus body 12. Side fences 23 are provided at both sides of the sheet feeding tray 21 to guide the side surfaces of the bundle of sheets stacked on the bottom plate 6 in the width direction (the direction perpendicular to the sheet feeding direction), and an end fence 10 is provided at the rear side of the bundle of sheets to press the rear end surfaces thereof.

Figure 8:
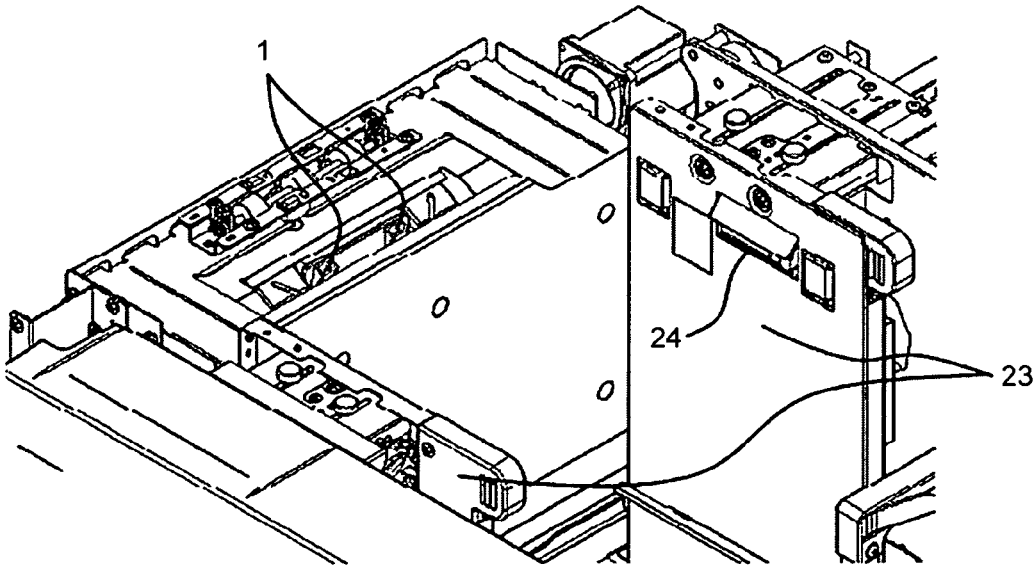
FIG. 8 is a diagram illustrating a state where a suction belt unit is separated from the sheet feeding device.

FIG. 8 is a diagram illustrating a state where the suction belt unit 22 is removed from the sheet feeding device 13. As illustrated in the drawing, a lift-blowing unit 1 is provided right below the suction belt unit to lift the sheet. The handling-blowing unit 24 is provided in each side fence 23 to separate the sheets from each other.

Next, embodiments of the invention corresponding to each claim will be described.

As described in the related art, in the existing sheet feeding device that lifts, separates, and absorbs sheets by using air, a double feeding or feeding failure is caused when the volume of air is not appropriately set in accordance with characteristics of the sheet to be fed. In one or more example embodiments, the characteristics of sheet mentioned herein indicate whether the sheet is light or heavy, whether the sheet is large or small, and whether the sheet is a coated sheet or not. For this reason, when the handling-blowing unit is configured to be capable of adjusting the volume of air blown to the sheets thereby so that the volume of air blown by the handling-blowing unit may be suitable for the sheet to be fed, all types of sheets may be reliably handled. The volume of air blown to the sheets is generally adjusted by changing of a duty (%) of the blower used as the handling-blowing unit.

Figure 9:
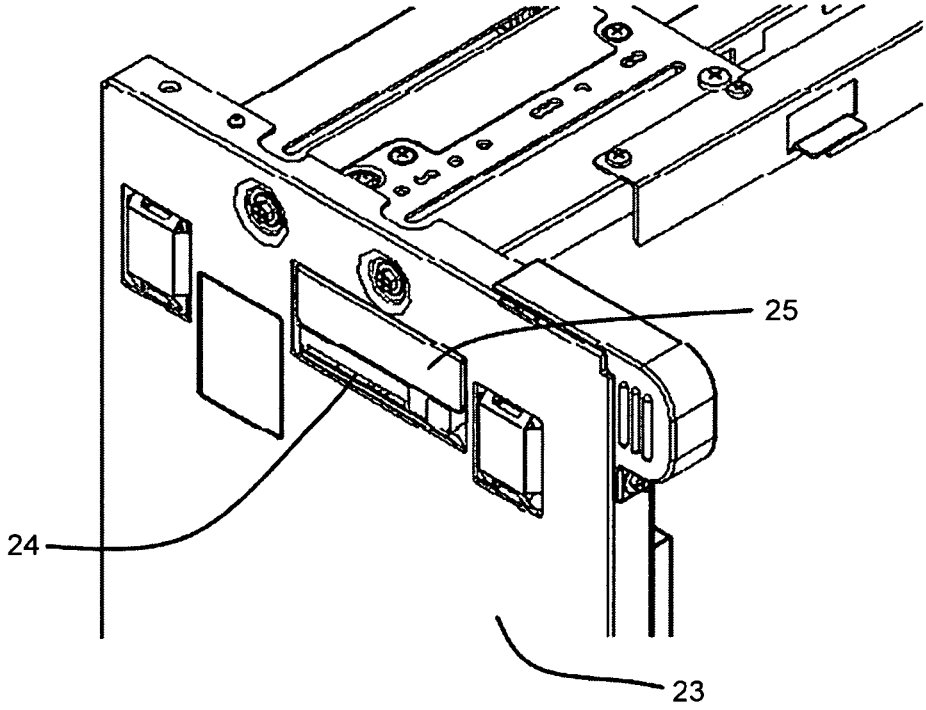
FIG. 9 is an enlarged view illustrating a handling-blowing unit.

The sheet feeding device in one or more example embodiments will be described with reference to FIGS. 9 to 12. FIG. 9 is an enlarged view illustrating a handling-blowing unit. A swingable actuator 25 is provided in the vicinity of a duct of the handling-blowing unit 24 provided in the side fence 23, and the actuator is movable in accordance with a change in the volume of air blown by the handling-blowing unit for separating the sheets from each other. FIG. 9 illustrates a state where the handling-blowing unit is not operating (air is not blowing from the handling-blowing unit), and the actuator 25 is not operating.

Figure 10:
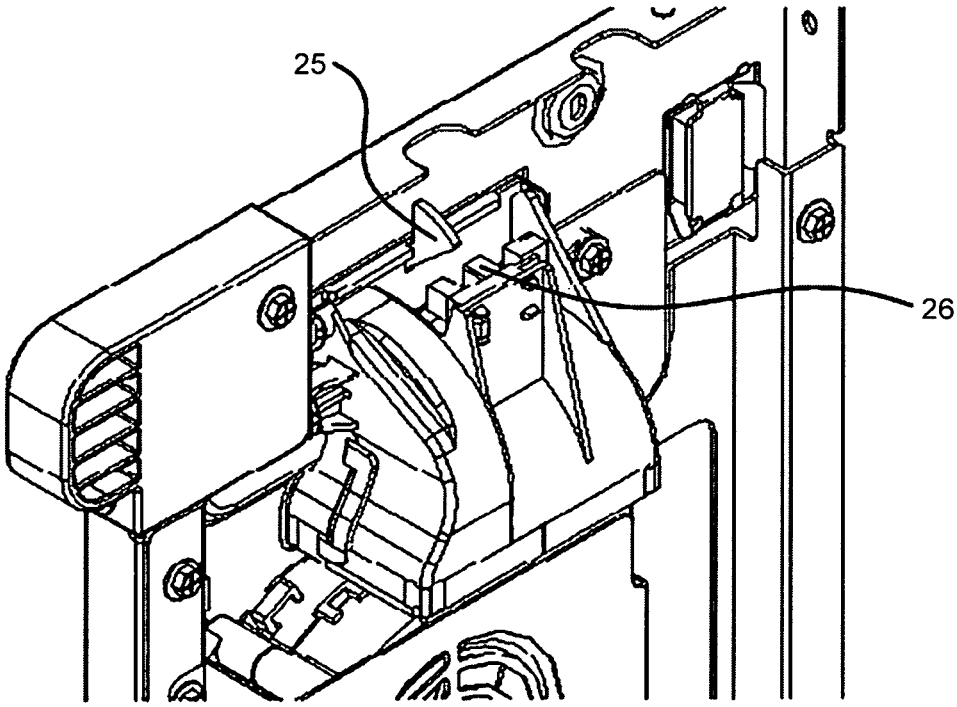
FIG. 10 is a rear view of FIG. 9.

FIG. 10 is a rear view of FIG. 9, and illustrates the inside of the handling-blowing unit. A swing position detecting sensor 26 is provided in the vicinity of the actuator 25 to detect the position of the actuator 25. The swing position of the actuator may be detected by the sensor.

Figure 11:
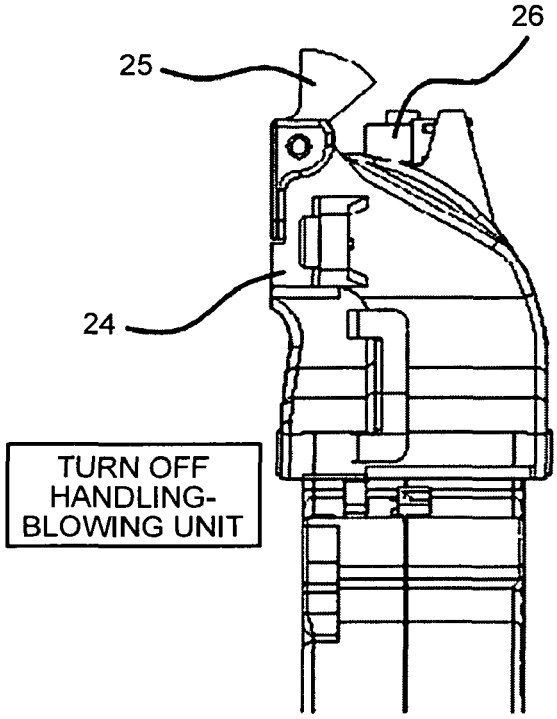
FIG. 11 is a diagram illustrating a state where the handling-blowing unit is not operating.
Figure 12:
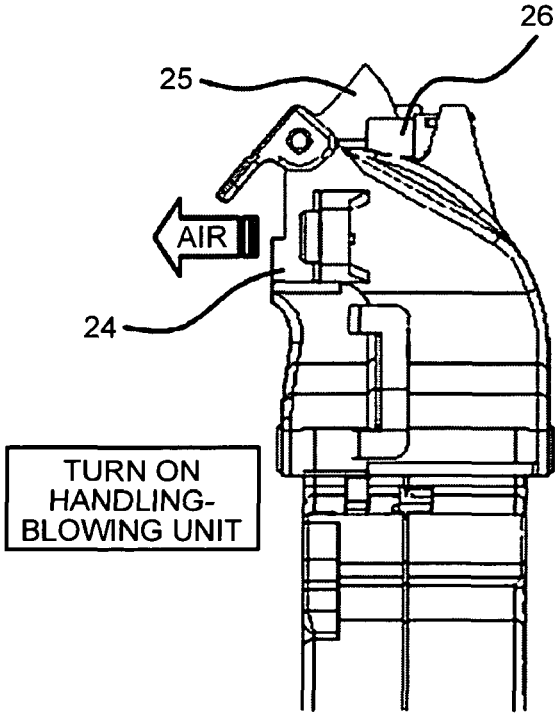
FIG. 12 is a diagram illustrating a state where the handling-blowing unit is operating.

FIG. 11 is a diagram illustrating a state where the handling-blowing unit 24 is not in operation, and FIG. 12 is a diagram illustrating a state where the handling-blowing unit 24 is in operation. As illustrated in FIG. 12, when the handling-blowing unit 24 is in operation, the actuator 25 is pressed and rotated by air discharged from an air blowing opening. The rotation amount of the actuator 25 becomes larger as the volume of air blown from the air blowing opening becomes larger, and the swing position detecting sensor 26 reacts to a certain volume of air.

As for the arrangement of the actuator 25 and the swing position detecting sensor 26, a standard value of the volume of air blown from the handling-blowing unit is set in advance and the swing position detecting sensor 26 is disposed at a position at which the swing position of the actuator 25 can be detected when air blows from the handling-blowing unit by the standard value. That is, the swing position detecting sensor 26 is set to reliably detect the actuator 25 when the set duty of the handling-blowing unit 24 is a certain value.

However, there may be cases where the blower does not reach a target volume of air due to an imbalance or degradation with time thereof even if the duty is set to a predetermined value. However, by adopting the above-described configuration, even when the swing position detecting sensor 26 cannot detect the actuator 25 at the set duty for the reason that the volume of air is low due to an imbalance and the volume of air is low due to degradation with time, a user may recognize such state of the blower in advance. Then, since the duty of the blower is adjustable as in the sheet feeding device of claim 1, the user may increase the volume of air blown to the sheets by the handling-blowing unit up to a stipulated value at which the swing position detecting sensor 26 detects the actuator 25 when the output of the blower is degraded. As a result, a double feeding or feeding failure may be prevented in advance.

In another example embodiment, a control device is provided to automatically check the detection state of the swing position detecting sensor 26 at the standard duty of the blower, and to automatically increase the duty of the blower when the swing position detecting sensor 26 does not detect the actuator at the standard duty of the blower. Accordingly, since the control device automatically adjusts the volume of air even when a user does not check the state of each blower, the user's effort may be largely reduced.

Here, the duty of when the swing position detecting sensor 26 detects the actuator 25 is referred to as a "standard duty." In the sheet feeding device, the duty of the blower is adjusted for each sheet in such a manner of "+X [%]" and "−Y [%]" on the basis of the standard duty. That is, for example, when the standard duty is 50[%], the table is obtained as below.

| Sheet | Lift-blowing unit<br>Handling-blowing unit<br>Air suctioning unit |
|---|---|
| A | +30 [%]<br>+20 [%]<br>+40 [%] |
| B | +10 [%]<br>−10 [%]<br>+30 [%] |
| C | −20 [%]<br>−40 [%]<br>+20 [%] |

Accordingly, even when there is a blower having a standard duty set to 55[%], the volume of air blown with respect to each sheet becomes constant at all times, thereby preventing an influence of an imbalance or degradation with time of the blower.

In an example embodiment, the volume of air blown by the handling-blowing unit is adjusted at a timing other than when the sheet is fed, for example, a timing at when the apparatus is turned on or before a sheet feeding job starts. In this manner, since the adjustment operation is performed at the timing other than when the sheet is fed, the standard duty of the blower is used all the time during which the sheet is fed, so that the sheet is reliably fed.

In another example embodiment, since a user may arbitrarily change a timing at which the volume of air blown by the handling-blowing unit is adjusted by the control device, the volume of air may be adjusted once in several times of the sheet feeding operation. In this manner, since the number of times of the adjustment operation decreases, power consumption may be decreased. Further, since the volume of air may be adjusted at an arbitrary timing such as when the user notices abnormality of the apparatus, for example, when a double feeding or feeding failure suddenly occurs, abrupt change in behavior of the blower may be handled.

In another example embodiment, when the swing position detecting sensor of the sheet feeding device does not react even when the volume of air blown by the handling-blowing unit is adjusted by the control device, failure of the handling-blowing unit is notified to a user interface unit of an image forming apparatus. Accordingly, the user may recognize failure of the handling-blowing unit and thus can take an action such as repairing the handling-blowing unit. Therefore, since the user may recognize failure of the apparatus before a jam or the like actually occurs, the user may not suffer from troublesome work such as removing the jam.

In another example embodiment, as described above in the related art, a double feeding or feeding failure is caused when the volume of air is set appropriately according to the characteristics of the sheet to be fed (the characteristics of the sheet mentioned herein indicate whether the sheet is light or heavy, the sheet is large or small, and the sheet is a coated sheet or not) in the sheet feeding device that lifts, separates, and absorbs the sheet by using air. Accordingly, even in the lift-blowing unit, if the volume of air is adjusted so that the volume of air blown by the lift-blowing unit may be appropriate for the sheet to be fed, all types of sheets may be reliably lifted. The volume of air blown by the lift-blowing unit is generally adjusted by changing the duty (%) of the blower used as the lift-blowing unit.

In another example embodiment, a swingable actuator is provided inside the lift-blowing unit of the sheet feeding device, and a swing position detecting sensor is provided to detect the position of the actuator, thereby detecting the swing position of the actuator. Accordingly, when the lift-blowing unit is operated, the actuator is pressed and rotated by air discharged from an air blowing opening. The rotation amount of the actuator becomes larger as the volume of air blowing from the air blowing opening becomes larger, and the swing position detecting sensor reacts up to a certain volume of air.

As for the arrangement of the actuator and the swing position detecting sensor, a standard value of the volume of blowing air from the lift-blowing unit is set in advance, and the swing position detecting sensor is disposed at a position at which the swing position of the actuator can be detected when air blows from the lift-blowing unit at the standard value. That is, the swing position detecting sensor is set to reliably detect the actuator when the set duty of the lift-blowing unit is a certain value. However, there may be cases where the blower cannot reach a target volume of air due to an imbalance or degradation with time thereof even if the duty is set to any value. However, by adopting the above-described configuration, when the swing position detecting sensor does not detect the actuator at the set duty even for the reason that the volume of air is low due to an imbalance and the volume of blowing air is low due to degradation with time, a user may recognize the state of the blower in advance. Then, since the duty of the blower is adjustable, the user may increase the volume of air blown by the lift-blowing unit up to a stipulated value at which the swing position detecting sensor detects the actuator when the output of the blower is degraded. As a result, a double feeding or feeding failure may be prevented in advance.

In another example embodiment, the sheet feeding device is provided with a control device which automatically checks the detection state of the swing position detecting sensor at the standard duty of the blower, and increases the duty of the blower when the swing position detecting sensor does not detect the actuator at the standard duty of the blower. Accordingly, since the control device automatically adjust the volume of air blown by the lift-blowing unit even when a user does not check the state of the blower, the user's effort may be largely reduced.

Here, the duty when the swing position detecting sensor detects the actuator is referred to as a "standard duty." The duty of the blower is adjusted for each sheet in such a manner of "+X [%]" and "−Y [%]" on the basis of the standard duty. That is, for example, when the standard duty is 50[%], the table is obtained as below.

| Sheet | Lift-blowing unit<br>Handling-blowing unit<br>Air suctioning unit |
|---|---|
| A | +30 [%]<br>+20 [%]<br>+40 [%] |
| B | +10 [%]<br>−10 [%]<br>+30 [%] |
| C | −20 [%]<br>−40 [%]<br>+20 [%] |

Accordingly, even when there is a blower having a standard duty of 55[%], the volume of air blown by the lift-blowing unit for each sheet becomes constant at all times, thereby preventing an influence of an imbalance or degradation in time of the blower.

In another example embodiment, the volume of air blown by the lift-blowing unit is adjusted in the sheet feeding device at a timing other than when the sheet is fed, for example, a timing at when the apparatus is turned on or before a sheet feeding job starts. In this manner, since the adjustment operation is performed at the timing when the sheet is not fed, the standard duty of the blower is used all the time during which the sheet is fed, thereby reliably feeding the sheet.

In another example embodiment, a user may arbitrarily change a timing of when the volume of air blown by the lift-blowing unit is adjusted by the control device of the sheet feeding device. Accordingly, the volume of blowing air may be adjusted once in several times of the sheet feeding operation. In this manner, since the number of times of the adjustment operation decreases, power consumption may be decreased. Further, since the volume of air blown by the lift-blowing unit may be adjusted at arbitrary timings such when the user notices abnormality of the apparatus, for example, a double feeding or feeding failure suddenly occurs, abrupt change in behavior of the blower may be handled.

In another example embodiment, when the swing position detecting sensor of the sheet feeding device does not react even when the volume of air blown by the lift-blowing unit is adjusted by the control device of the sheet feeding device, failure of the lift-blowing unit is notified to a user interface unit of an image forming apparatus. Accordingly, the user may recognize failure of the lift-blowing unit and take an action such as conducing repairing of the lift-blowing unit. Therefore, since the user may recognize failure of the apparatus before a jam or the like actually occurs, the user may not suffer from a troublesome job such as removing the jam.

In another example embodiment, as described above in the related art, a double feeding or feeding failure is caused when the volume of air is not set appropriately for the characteristics of the sheet to be fed (the characteristics of the sheet mentioned herein indicate whether the sheet is light or heavy, the sheet is large or small, and the sheet is a coated sheet or not) in the sheet feeding device that lifts, separates, and absorbs the sheet by using air. For this reason, even for the air suctioning unit, the volume of air suctioned thereby is made adjustable so that the volume of air becomes appropriate for the sheet to be fed. Accordingly, all types of sheets may be reliably absorbed. The volume of air is generally adjusted by changing the duty (%) of the blower used as the air suctioning unit.

In another example embodiment, a swingable actuator is provided inside the air suctioning unit of the sheet feeding device, and a swing position detecting sensor is provided to detect the position of the actuator. Thus, the swing position of the actuator is detected. Accordingly, when the air suctioning unit is operated, the actuator is pressed and rotated by air suctioned from an air suctioning opening. The rotation amount of the actuator becomes larger as the volume of air suctioned from the air suctioning opening becomes larger, and the swing position detecting sensor reacts to a certain volume of air.

As for the arrangement of the actuator and the swing position detecting sensor, a standard value of the volume of air from the air suctioning unit is set in advance, and the swing position detecting sensor is disposed at a position at which the swing position of the actuator can be detected when air is suctioned by the air suctioning unit by the standard value. That is, the swing position detecting sensor is set so as to reliably detect the actuator when the set duty of the air suctioning unit is a certain value.

However, there may be cases where the blower cannot reach a target volume of air suctioned by the air suctioning unit due to an imbalance or degradation with time thereof even if the duty is set to a predetermined value. However, by adopting the above-described configuration, the swing position detecting sensor does not detect the actuator at the set duty for the reason that the volume of air suctioned by the air suctioning unit is low due to an imbalance and the volume of suctioning air is low due to degradation in time, so that a user may recognize the state of the blower in advance. Then, since the duty of the blower is adjustable, the user may increase the volume of air suctioned by the air suctioning unit up to a stipulated value at which the swing position detecting sensor detects the actuator when the output of the blower is degraded. As a result, feeding failure may be prevented in advance.

In another example embodiment, the sheet feeding device is provided with a control device which automatically checks the detection state of the swing position detecting sensor at the standard duty of the blower, and increases the duty of the blower when the swing position detecting sensor does not detect the actuator at the standard duty of the blower. Accordingly, since the control device automatically adjusts the volume of air suctioned by the air suctioning unit even when a user does not check the state of each blower, the user's effort may be largely reduced. Here, the duty of when the swing position detecting sensor detects the actuator is referred to as a "standard duty." In the sheet feeding device, the duty of the blower is adjusted for each sheet in such a manner of "+X [%]" and "−Y [%]" on the basis of the standard duty. That is, for example, when the standard duty is 50[%], the table is obtained as below.

| Sheet | Lift-blowing unit<br>Handling-blowing unit<br>Air suctioning unit |
|---|---|
| A | +30 [%]<br>+20 [%]<br>+40 [%] |
| B | +10 [%]<br>−10 [%]<br>+30 [%] |
| C | −20 [%]<br>−40 [%]<br>+20 [%] |

Accordingly, even when there is a blower having a standard duty set to 55[%], the volume of air suctioned by the air suctioning unit for each sheet becomes steady at all times, thereby preventing an influence of an imbalance or degradation in time of the blower.

In another example embodiment, the volume of air suctioned by the suctioning unit is adjusted in the sheet feeding device at a timing other than when the sheet is fed, for example, a timing at when the apparatus is turned on or before a sheet feeding job starts. In this manner, since the adjustment operation is performed at the timing when the sheet is not fed, the standard duty of the blower is used all the time during which the sheet is fed, thereby reliably feeding the sheet.

In another example embodiment, a user may arbitrarily change a timing at which the volume of air suctioned by the air suctioning unit is adjusted by the control device of the sheet feeding device. Accordingly, the volume of air suctioned by the air suctioning unit may be adjusted once in several times of the sheet feeding operation. In this manner, since the number of times of the adjustment operation decreases, power consumption may be decreased. Further, since the volume of air may be adjusted at an arbitrary timing when the user notices abnormality of the apparatus, for example, a double feeding or feeding failure suddenly occurs, abrupt modulation of the blower may be handled.

In another example embodiment, when the swing position detecting sensor of the sheet feeding device does not react even when the volume of air suctioned by the air suctioning unit is adjusted by the control device of the sheet feeding device, failure of the air suctioning unit is notified to a user interface unit of an image forming apparatus. Accordingly, the user may recognize failure of the air suctioning unit and take an action such as conducing repairing of the air suctioning unit. Therefore, since the user may recognize failure of the apparatus before a jam or the like actually occurs, the user may not suffer from a troublesome job such as to remove the jam.

In an image forming apparatus including one or more example embodiments, there can be provided a sheet feeding device which maintains an appropriate force of blowing or suctioning air regardless of an imbalance of each blower or a variation with time of characteristics thereof and which reliably feeds the sheet. Thus, the transportation quality of the apparatus improves.

According to one aspect of the invention, the duty of a blower of a handling-blowing unit is adjusted so that a volume of air blown by a handling-blowing unit ma becomes suitable for the sheet to be fed. Therefore, many types of sheets may be reliably handled.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a lift-blowing unit which blows air to a plurality of sheets stacked on a tray to lift an uppermost sheet from the sheets;

a sheet absorbing unit which absorbs the sheet lifted by the lift-blowing unit by a negative pressure;

an air suctioning unit which supplies the negative pressure to the sheet absorbing unit by air suction;

a handling-blowing unit which handles the sheets by blowing air to the sheets absorbed onto the sheet absorbing unit, wherein at least one of the handling-blowing unit, the lift-blowing unit, and the air suctioning unit includes:

a swingable element which moves in accordance with a change in the volume of air blown or suctioned by the handling-blowing unit, the lift-blowing unit or the air suctioning unit; and a swing position detecting sensor which detects a position of the swingable element, wherein the handling-blowing unit, the lift-blowing unit or the air suctioning unit adjusts the volume of air blown or suctioned thereby, in accordance with an output of the swing position detecting sensor; and a sheet transporting unit which transports the absorbed sheet.

2. The sheet feeding device of claim 1, further comprising:

a control device which adjusts the volume of air blown by the handling-blowing unit in accordance with an output of the swing position detecting sensor.

3. The sheet feeding device of claim 2, wherein the control device adjusts the volume of air blown by the handling-blowing unit at a timing other than when the sheet is fed, in accordance with an output of the swing position detecting sensor.

4. The sheet feeding device of claim 2, wherein the control device changes a timing for adjusting the volume of air blown by the handling-blowing unit in accordance with an output of the swing position detecting sensor.

5. The sheet feeding device of claim 2, wherein, when the swing position detecting sensor does not react as a result of the adjustment of the volume of air by the control device, failure of the handling-blowing unit is notified to a user interface unit of an image forming apparatus equipped with the sheet feeding device.

6. The sheet feeding device of claim 1, further comprising:

a control device which adjusts the volume of air blown by the lift-blowing unit in accordance with an output of the swing position detecting sensor.

7. The sheet feeding device of claim 6, wherein the control device adjusts the volume of air blown by the lift-blowing unit at a timing other than when the sheet is fed, using the swing position detecting sensor.

8. The sheet feeding device of claim 6, wherein the control device changes a timing for adjusting the volume of air blown by the lift-blowing until in accordance with an output of the swing position detecting sensor.

9. The sheet feeding device of claim 6, wherein, when the swing position detecting sensor does not react as a result of the adjustment of the volume of air by the control device, failure of the lift-blowing unit is notified to a user interface unit of an image forming apparatus equipped with the sheet feeding device.

10. The sheet feeding device of claim 1, further comprising:

a control device which adjusts the volume of air suctioned by the air suctioning unit in accordance with an output of the swing position detecting sensor.

11. The sheet feeding device of claim 10, wherein the control device adjusts the volume of air suctioned by the air suctioning unit at a timing other than when the sheet is fed, in accordance with an output of the swing position detecting sensor.

12. The sheet feeding device of claim 10, wherein the control device changes a timing for adjusting the volume of air suctioned by the air suctioning unit in accordance with an output of the swing position detecting sensor.

13. The sheet feeding device of claim 10, wherein, when the swing position detecting sensor does not react as a result of the adjustment of the volume of air by the control device, failure of the air suctioning unit is notified to a user interface unit of an image forming apparatus equipped with the sheet feeding device.

14. An image forming apparatus comprising the sheet feeding device of claim 1.

* * * * *